US005382216A

United States Patent [19]

Willing

[11] Patent Number: 5,382,216

[45] Date of Patent: Jan. 17, 1995

[54] METHOD OF MANUFACTURING PACKAGING BAGS WITH A HANDLE

[75] Inventor: Josef Willing, Vreden, Germany

[73] Assignee: M &W Verpackungen Mildenberger & Willing GmbH, Gronau, Germany

[21] Appl. No.: 163,415

[22] Filed: Dec. 7, 1993

Related U.S. Application Data

[62] Division of Ser. No. 983,908, Dec. 1, 1991, Pat. No. 5,322,450.

[30] Foreign Application Priority Data

Aug. 6, 1992 [DE] Germany ..... 4225998

[51] Int. Cl.[6] ..... B31B 1/86

[52] U.S. Cl. ..... 493/226; 493/197; 493/223; 493/926

[58] Field of Search ..... 493/193-197, 493/199-202, 210, 218, 219, 223, 224, 226, 254, 926

[56] References Cited

U.S. PATENT DOCUMENTS

| | | | |
|---|---|---|---|
| 3,548,723 | 12/1970 | Sengewald | 493/226 |
| 3,568,576 | 3/1971 | Lehmacher | 493/226 |
| 4,398,903 | 8/1983 | Lehmacher | 493/226 |
| 4,857,037 | 8/1989 | Schwinn | 493/195 |
| 4,874,256 | 10/1989 | Baines | 493/226 |
| 4,913,693 | 4/1990 | Ball | 493/226 |
| 4,931,033 | 6/1990 | Leeds | 493/926 |
| 5,026,173 | 6/1991 | Jensen | 493/226 |

FOREIGN PATENT DOCUMENTS

| | | | |
|---|---|---|---|
| 0303726 | 2/1989 | European Pat. Off. | 493/210 |

*Primary Examiner*—Jack W. Lavinder
*Attorney, Agent, or Firm*—Karl F. Milde, Jr.

[57] ABSTRACT

A method of manufacturing bags that are rectangular when collapsed and which comprise two superimposed flat sides, sealed at the edges, and a handle member. The method comprises the steps of: laying out a web forming three parallel subordinate webs, one extending longitudinally in the middle and one on each lateral side thereof; folding two top flanks out of the middle subordinate web to create a handle-top portion; V-folding a center strip of the middle subordinate web to create a handle member; providing the handle member with a finger slot and with depressions that allow the middle part to be pulled apart along the handle member to form a gusset; bringing the two lateral subordinate webs together; and attaching the lateral subordinate webs together along seams to create bag edges and cutting off the bags along their edges.

7 Claims, 8 Drawing Sheets

METHOD OF MANUFACTURING PACKAGING BAGS WITH A HANDLE

This application is a division of application Ser. No. 07/983,908 filed Dec. 1, 1992, now issued as U.S. Pat. No. 5,322,450.

BACKGROUND OF THE INVENTION

The invention concerns a method of manufacturing packaging bags. The bags are rectangular when collapsed. They consist of two superimposed flat sides sealed at the edges and of a handle that protrudes from the top.

A method for manufacturing bags of this type is disclosed in the German Utility Model Patent No. GM 1 929 964. The bags described in this patent are made of thermoplastic foil. A carrying handle with a stamped-out finger slot is associated with each blank. The handle is made of a material that is more rigid than the material forming the sides of the bag. The drawback of this method is that it does not leave what is called a "gusset" to close off the opening at the top of the bag.

SUMMARY OF THE INVENTION

The principle object of the present invention is accordingly to provide a method of mass producing bags with both a handle and a top. It will be possible in accordance with the invention to make each bag out of a single blank, although the handle can be reinforced if desirable.

This object, as well as other objects which will become apparent in the discussion that follows, are achieved in accordance with the invention by means of a method comprising the following series of steps: A web is laid out consisting of three parallel longitudinal sections or "subordinate", one in the middle and one on either side. In one preferred embodiment of the method, handle/top members are created by folding two top flanks out of the middle subordinate web. A handle is then fashioned by V-folding the strip of the middle subordinate web longitudinally between the handle/top members. In another preferred embodiment the middle subordinate web is cut longitudinally and a separate handle member is attached in the form of a handle strip to at least one of the top flanks. The handle is provided with a finger slot and depressions, whereby the latter will later allow the middle portion to be pulled apart along the handle component into a gusset. Thereafter, the lateral subordinate webs are brought together and sealed (e.g., by heat) to form the edges, and the individual bags are finally cut off at these edges.

One advantage of the method in accordance with the invention is that it is possible to manufacture a bag wherein the sides are made from the same web material as the top and handle or from a different material.

Another advantage is that the folded-out middle strip can be provided with a reinforcing strip if it is not strong enough.

The additional reinforcing handle strip can be a single-layer flap-like strip attached to one or both top flanks. It can also be V-shaped with each side secured to a top flank.

Another advantage is that, when the handle component is V-shaped, a seam can be applied in the vicinity of the transition between the handle member and the top flanks. This advantage will be present even when the handle member, top, and sides are in one piece.

The web can also be composed of at least two separate webs arranged in parallel. In this case preferably the separate webs will essentially be contiguous with the subordinate webs, meaning that the web consists of two separated subordinate webs and that the gap between them is spanned by a middle web secured to the separated subordinate webs in overlapping relationship.

The bag can be made of paper, a paper-to-plastic laminate, or a plastic. Thickness, tensile strength, printing qualities, etc. will determine what material is employed.

The materials can also differ, with the sides made of polyethylene and the handle of cardboard for example. Combinations, however, are not preferred because they make recycling more difficult.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
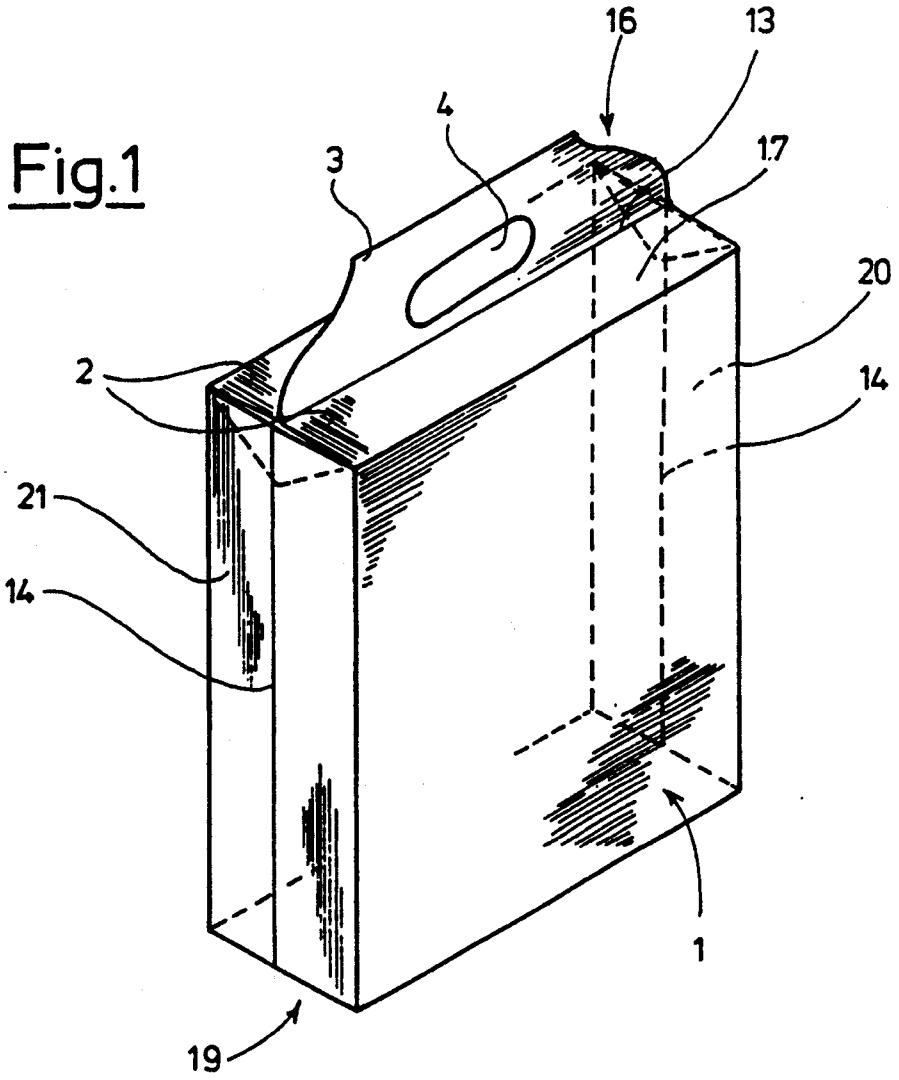
FIG. 1 is a perspective view of an erected bag manufactured in accordance with a first preferred embodiment of the present invention.

The bag 1 illustrated in FIG. 1 has at its gusset a handle-top element 16 that is in one piece with the rest of the bag. Handle-top element 16 consists of a handle member 3 and a top member 2 that are in one piece and have a visible line of separation extending along a seam 13. The handle 3 has a finger opening or slot 4. The outer edges of the top 2 merge into sidewall/edgewall portions 20 and 21. On each side of the handle 3 is a top flank 17 and 17'.

The preferred material for the bag of FIG. 1 is conventional polyolefin (polypropylene or polyethylene) foil.

The opposite ends of the sidewall/edgewall portions 20 and 21 in the empty bag are not connected, leaving an open bottom area 19. The method that will now be specified results in a strong bag with a novel handle design that produces an aesthetically pleasing cushion-like appearance.

The preferred embodiment of the method of manufacturing such a bag 1 will now be described with reference to FIGS. 2 through 5.

Figure 2:
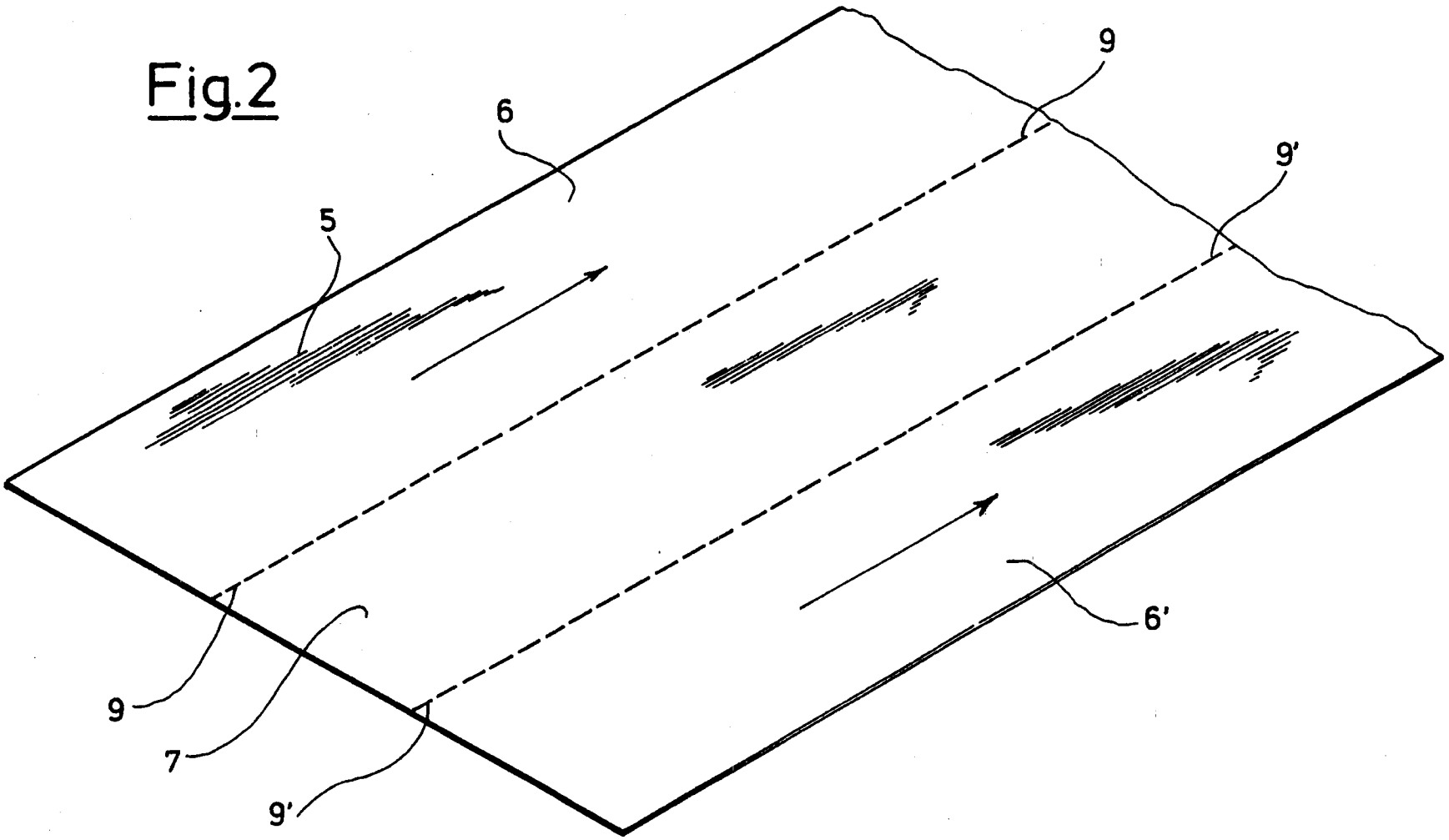
FIGS. 2, 3, 4*a*, 4*b* and 5 are schematic representations of various stages in a first preferred embodiment of a method of manufacturing a bag according to the present invention, to produce a bag of the type shown in FIG. 1.

A web 5 of sufficient width, as schematically illustrated in FIG. 2, is drawn from a cylindrical reel of material (not shown). The web is divided, initially in concept only, into three parallel longitudinal sections on "subordinate webs": a middle (i.e. subordinate webs) 7, and two lateral subordinate webs 6 and 6', one on the right and one on the left as shown in the figure. The three are separated by imaginary lines represented by dashed lines 9 and 9' in the figure. The middle subordinate web 7, from which the handle-top element 16 will be extracted in the next stage, is between lateral subordinate webs 6 and 6'.

Figure 3:
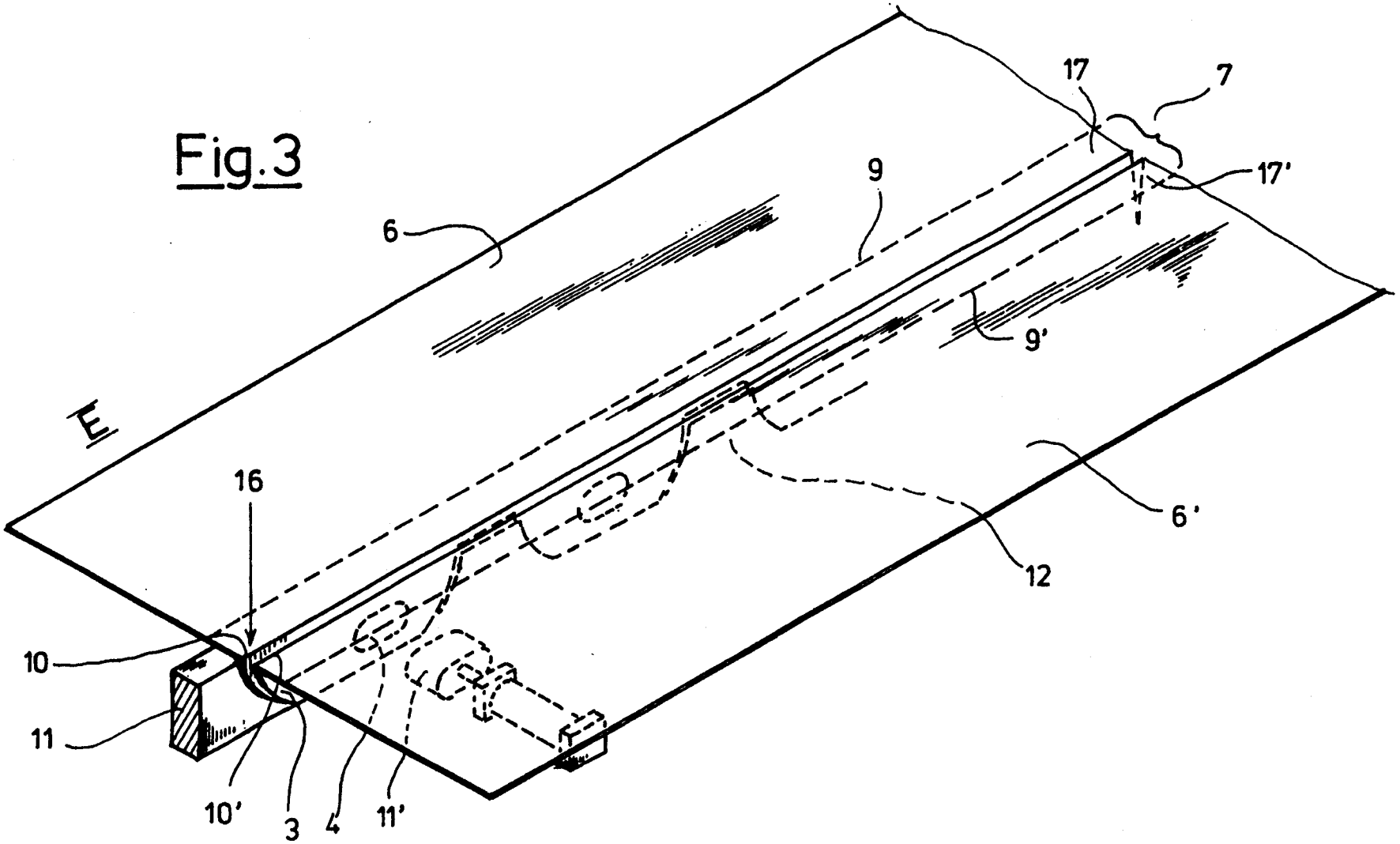

As will be evident from FIG. 3, the middle subordinate web 7 is folded by down in a V by an appropriate (unillustrated) mechanism, producing creases 10 and 10'. Lateral subordinate webs 6 and 6' remain in parallel. A handle-top element 16 is accordingly created out of the middle subordinate web 7. The handle member 3 now points vertically downward in the form of a V out of the plane E of the sheet of material. Two top flanks 17 and 17' are derived from the remaining width of the middle subordinate web 7. These flanks together constitute the top portion of the bag. A connecting seam 13 is now established, as will be evident from FIG. 4*b*, precisely along creases 10 and 10', creating a tube out of the V-shaped handle member 3. This handle member can be provided with a reinforcing strip if it is not strong enough. The additional reinforcing handle strip can be a single-layer flap-like strip attached to one or both top flanks. It can also be V-shaped with each side secured to a top flank.

The dies 11 and 11' illustrated in FIG. 3 stamp finger slots 4 and cutouts 12 out of handle member 3, allowing the gusset 2 to be formed when the bag is loaded.

Figures 4A, 4B, 5:
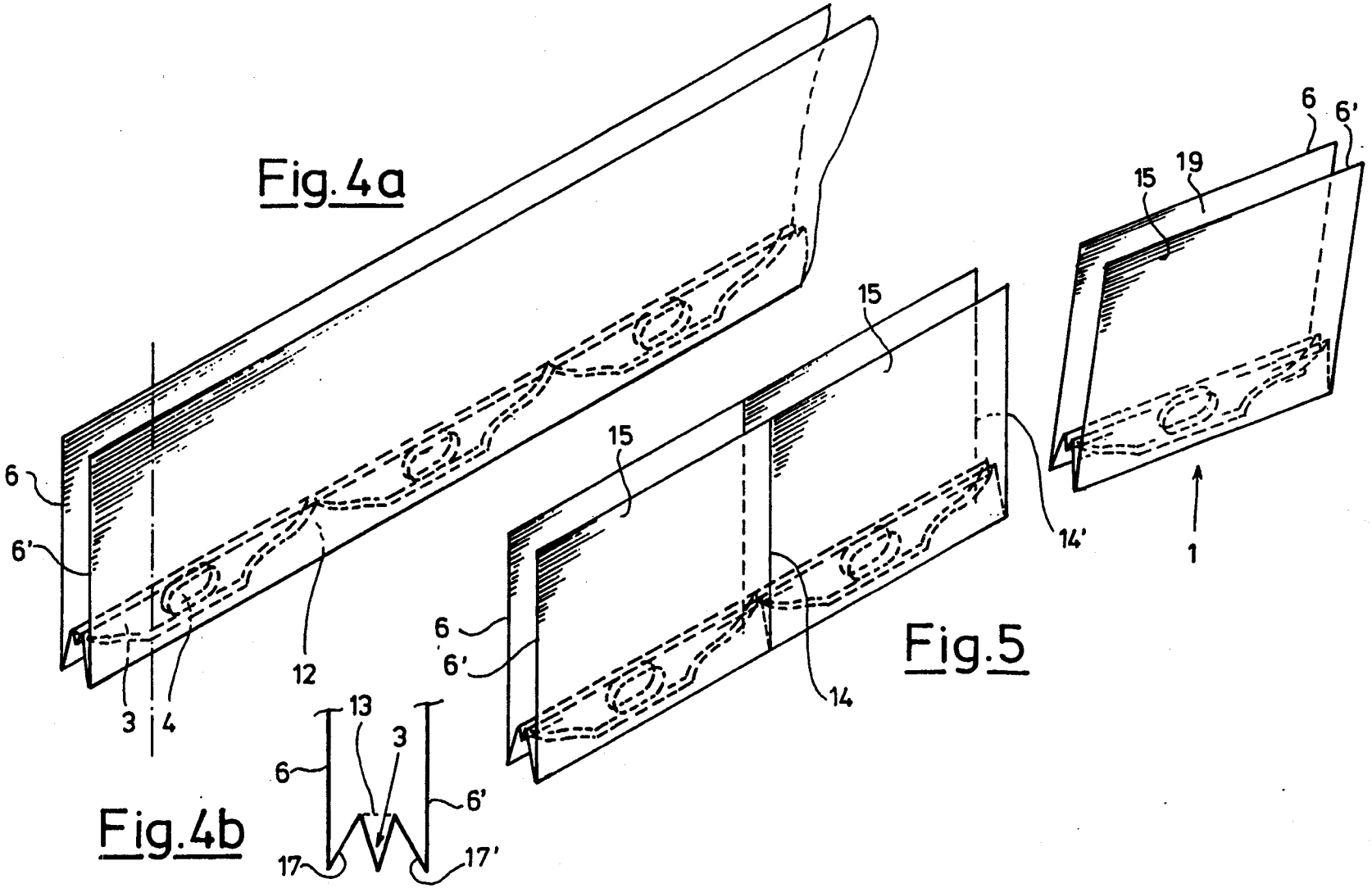

Another inward fold is next established along lines 9 and 9' as shown in FIG. 4*a*. The inward-extending top flanks 17 and 17' enter and create the W shape illustrated in the section in FIG. 4*b*. It is accordingly now possible to speak of a W fold, with the two central flanks creating the more or less downwardly extending handle member 3. The central flanks of the W are also to some extent connected in that the seam 13 is present on one part. The seam is represented apart by the broken line in FIG. 4*b*.

In a final step, illustrated in FIG. 5, the still separate lateral subordinate webs 6 and 6' are secured to each other with welded seams along the lines 14 and 14'. The individual bags 1 are also simultaneously separated from the web along the lines 14 and 14'. Since the bottom area 19 is still open, the bag can be immediately filled.

Once the bag 1 is full, its bottom 19 is closed, for example by folding and heat sealing.

Figure 10:
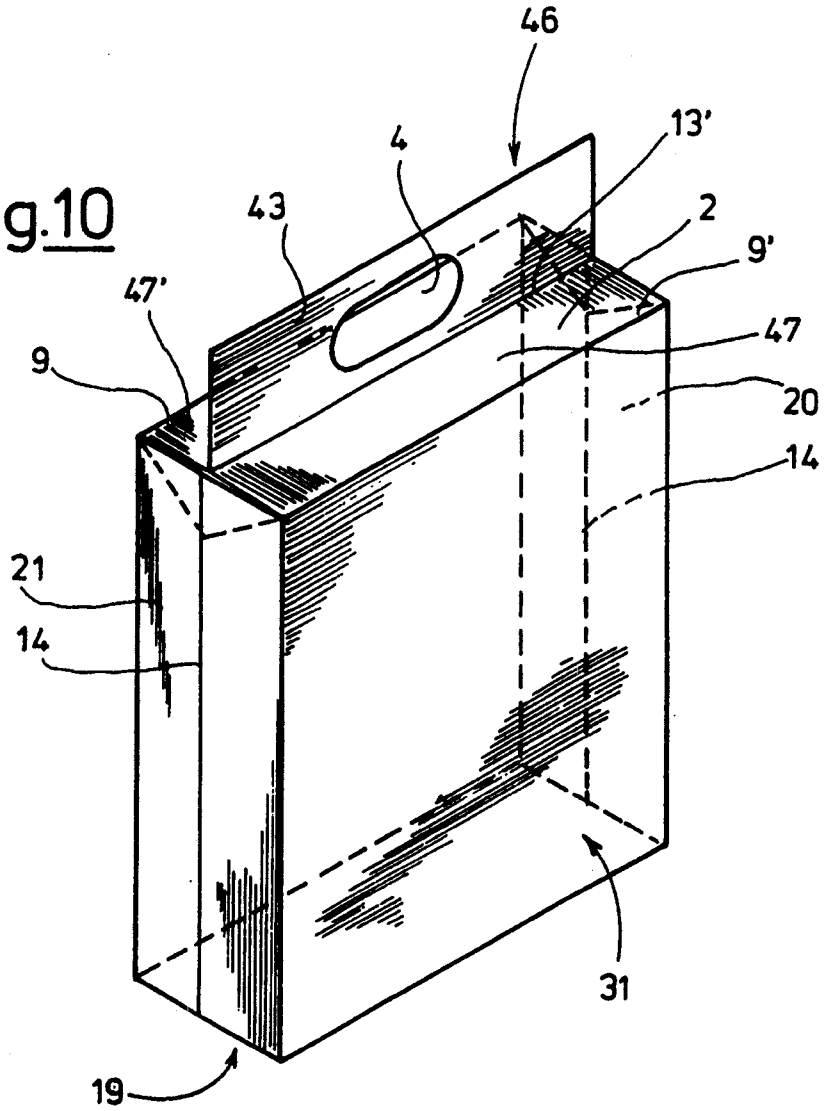
FIG. 10 is a perspective view of an erected bag manufactured in accordance with the second preferred embodiment of the present invention.

FIG. 10 illustrates a bag manufactured in accordance with a second preferred embodiment of the present invention. Similar parts are labeled with the same reference numbers as they are on the bag of FIG. 1.

The bag 31 illustrated in FIG. 10 lacks a handle-top element 46 in one piece with the rest of the bag. Handle-top element 46 consists of a handle member 43 and of a top 2 in two parts and connected along a seam 13'. The handle member 43 has a finger slot 4. The outer edges of the top 2 merge into the sidewall and edgewall portions 20 and 21.

The preferred materials for this bag are conventional polyolefins (polypropylene or polyethylene).

Before the bag is loaded the ends of the side and edge members 20 and 21 opposite the top 2 are not connected, leaving an open bottom area 19. The second embodiment of the method also results in a bag 31 that is strong, has an attractive handle, and resembles a cushion.

The bag 31 of FIG. 10 is manufactured in accordance with a second preferred method which will now be described with reference to FIGS. 2 and 6 through 9. As already described in connection with FIG. 2, a web 5 is drawn from a cylindrical reel (not shown). The web is divided, initially in concept only, into three parallel, longitudinal sections or subordinate webs, specifically a middle subordinate web 7, and two lateral subordinate webs 6 and 6', separated by imaginary lines represented by the dashed lines 9 and 9'. The middle subordinate web 7, from which the handle-top element 16 will be created in the next stage, is between the lateral subordinate webs 6 and 6'.

Figure 6:
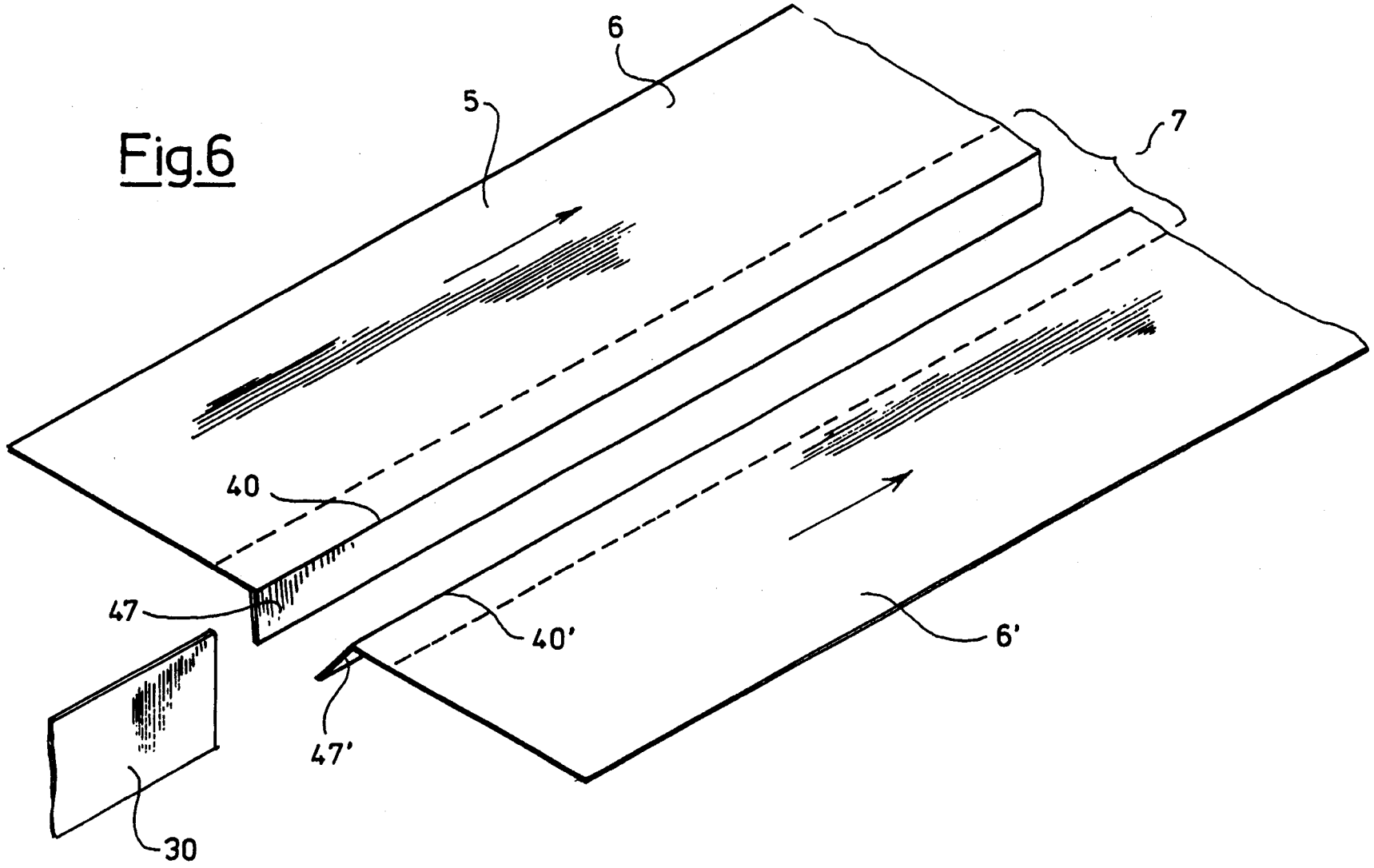
FIGS. 6 through 9 are schematic representations of various stages in a second preferred embodiment of a method of manufacturing a bag according to the present invention, to produce a bag of the type shown in FIG. 10.

Referring to FIG. 6, we see that the middle subordinate web 7 has been cut longitudinally by a mechanical slitter. Appropriate mechanisms (not shown) fold the two top flanks 47 and 47' of the slit web along creases 40 and 40'. An additional, separate handle strip 30 of one or more layers of material is now inserted between the top flanks 47 and 47'. It is also possible to insert a strip of cardboard. Handle strip 30 is now attached to top flanks 47 and/or 47' by pressure and linear or surface-to-surface hot bonding and/or cementing. It is also possible to insert a V-shaped handle strip 30 with its base (apex) facing either in or out of the bag.

Figure 7:
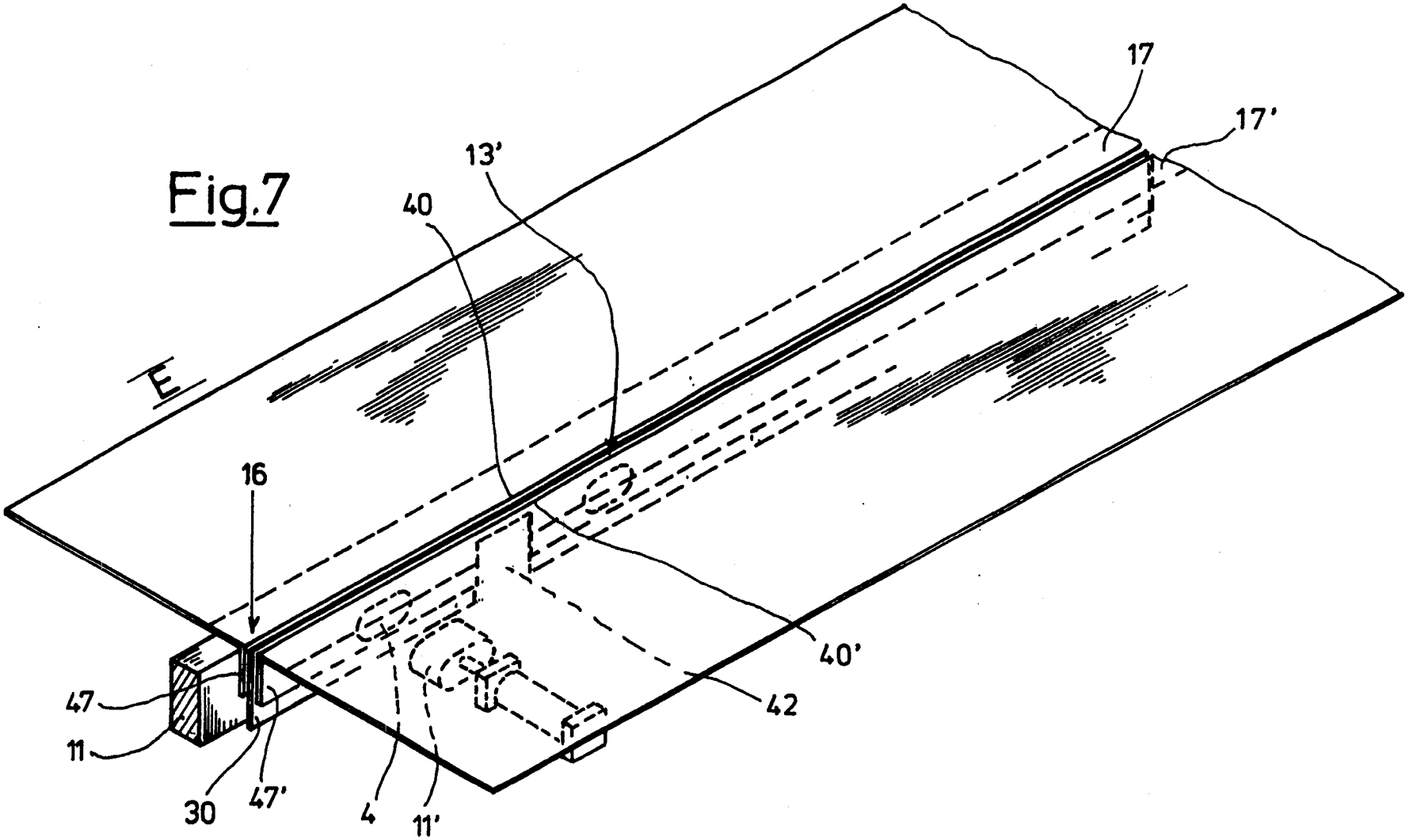

The handle-top element 46 of the bag is next produced in the manner illustrated in FIG. 7. The handle strip 30 cemented or hot bonded between top flanks 47 and 47' points vertically downward, out of the plane E of the web. As will be evident from FIGS. 7 and 10, a seam 13' is applied precisely at the creases 40 and 40', creating a protruding handle member 43.

The dies 11 and 11' illustrated in FIG. 7 now stamp finger slots 4 and depressions 42 out of the handle member 43, allowing the top 2 to be pulled apart when the bag is loaded. The latter state is illustrated in FIG. 8, whereby lateral subordinate webs 6 and 6' are positioned in parallel.

Figures 8, 9:
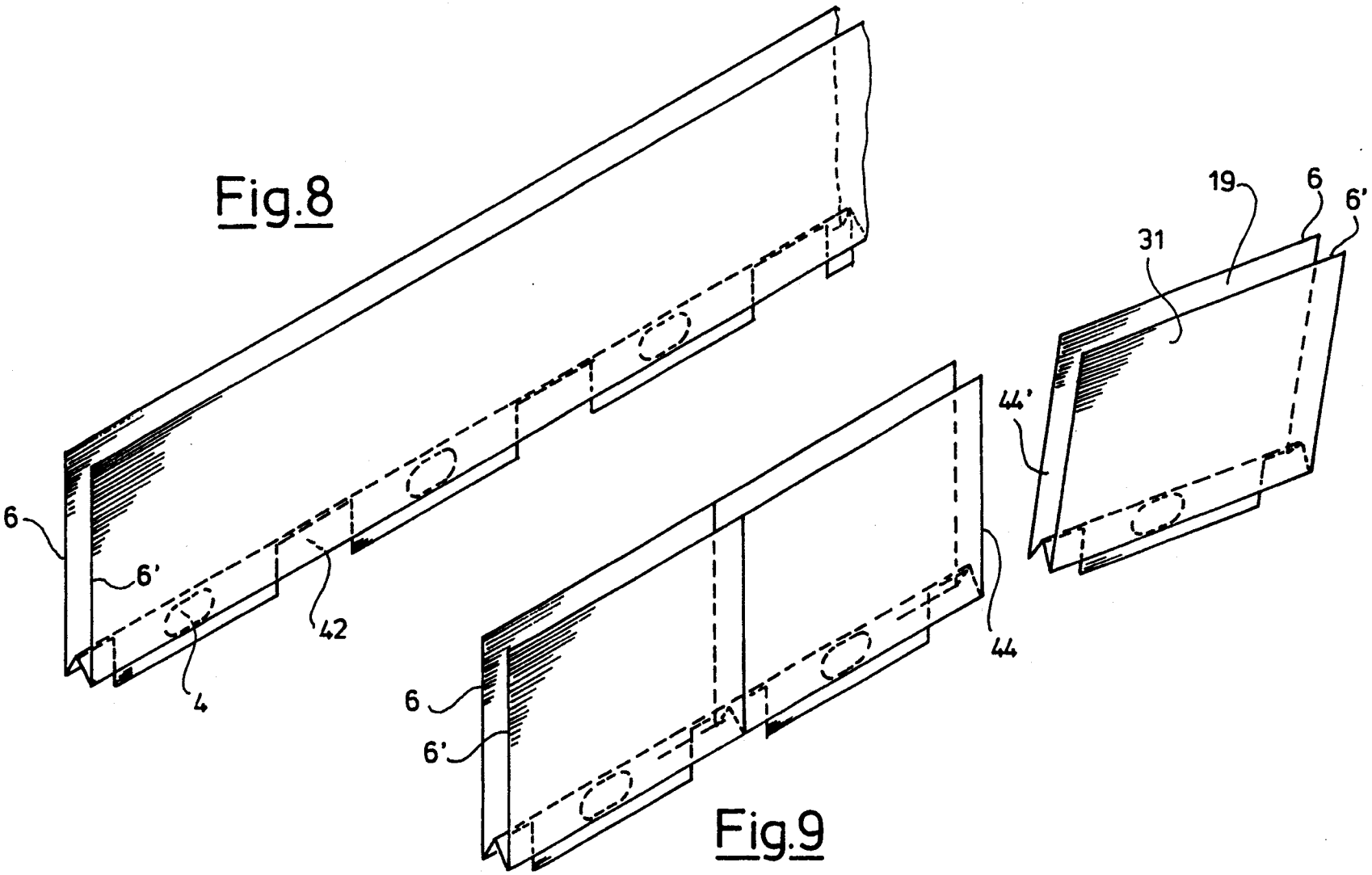

In the penultimate step illustrated in FIG. 9 the still separate lateral subordinate webs 6 and 6' are secured to each other with welded seams along lines 44 and 44'. The individual bags 31 are simultaneously separated from the web along these lines 44 and 44'. Since the bottom area 19 is still open, the bags can be immediately filled.

Once they are filled, bags 31 are closed at the bottom by folding and heat sealing.

There has thus been shown and described a novel method of manufacturing packaging bags with a handle which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method of manufacturing bags that are rectangular when collapsed and which comprise two superimposed flat sides, sealed at the edges, and a handle member, said method comprising the steps of: laying out in a plane a single web forming three adjacent parallel, longitudinal sections, one lateral section on each lateral side of the web and a middle section therebetween; longitudinally separating the middle section and longitudinally folding the separated edges substantially out of the plane to form adjacent top flanks; attaching a separate strip-shaped handle member to at least one of the top flanks; providing the handle member with a finger slot and with cutouts that allow the middle section to be pulled apart along the handle member to form a gusset; bringing the two lateral sections together; and attaching the lateral sections together along seams to create bag edges and cutting off the bags along their edges.

2. The method defined in claim 1, wherein the handle member is made of a different material than the rest of the web.

3. The method defined in claim 1, wherein the additional handle member is shaped like a V with each side attached to a top flank.

4. The method defined in claim 1, wherein the additional handle member is in the form of a flat flap with each side secured to at least one top flank.

5. The method defined claim 1, wherein when the handle member is V-shaped and wherein a seam is applied longitudinally in the vicinity of the transition between the handle member and the top flanks.

6. The method defined in claim 1, wherein the web consists of at least two separate parallel webs.

7. The method defined in claim 6, wherein the web comprises two separated, outer subordinate webs and wherein the distance between them is spanned by a third, middle subordinate web secured to the outer subordinate webs in overlapping relationship, whereby the separate webs are essentially identical with the subordinate webs.

* * * * *